US008357271B2

(12) United States Patent
Morimitsu

(10) Patent No.: US 8,357,271 B2
(45) Date of Patent: Jan. 22, 2013

(54) ANODE FOR USE IN ZINC AND COBALT ELECTROWINNING AND ELECTROWINNING METHOD

(75) Inventor: Masatsugu Morimitsu, Kyoto (JP)

(73) Assignee: The Doshisha, Kyoto (JP)

( * ) Notice: Subject to any disclaimer, the term of this patent is extended or adjusted under 35 U.S.C. 154(b) by 168 days.

(21) Appl. No.: 12/997,127

(22) PCT Filed: Jun. 9, 2009

(86) PCT No.: PCT/JP2009/060504

§ 371 (c)(1),
(2), (4) Date: Dec. 9, 2010

(87) PCT Pub. No.: WO2009/151044

PCT Pub. Date: Dec. 17, 2009

(65) Prior Publication Data

US 2011/0079518 A1 Apr. 7, 2011

(30) Foreign Application Priority Data

Jun. 9, 2008 (JP) ..... 2008-151007
Jun. 23, 2008 (JP) ..... 2008-163714

(51) Int. Cl.
*C25B 11/06* (2006.01)
*C25B 11/08* (2006.01)

(52) U.S. Cl. ..... 204/291; 204/290.01; 204/290.13; 205/574; 205/575; 205/602; 205/603; 205/588

(58) Field of Classification Search ..... 204/290.01, 204/290.13, 291; 205/574, 575, 602, 603, 205/587, 588

See application file for complete search history.

(56) References Cited

U.S. PATENT DOCUMENTS 3,718,551 A 2/1973 Martinsons
4,431,196 A * 2/1984 Kutnyak ..... 473/588
4,663,010 A * 5/1987 Debrodt et al. ..... 204/290.12
6,210,550 B1 4/2001 Nidola et al.
7,591,934 B2 * 9/2009 Marsden et al. ..... 204/269
2009/0288856 A1 * 11/2009 Sandoval et al. ..... 174/126.2
2009/0288958 A1 * 11/2009 Sandoval et al. ..... 205/576

FOREIGN PATENT DOCUMENTS

JP 07-258697 10/1995
JP 2004-238697 A 8/2004
JP 2007-146215 A 6/2007
JP 2007-162050 6/2007

OTHER PUBLICATIONS

Torjus Akre, et al., "The Anode Process in Cobalt Electrowinning", Electrochemical Society Proceedings vol. 2004-18, pp. 276-287.

Nijjer S. et al., "Cyclic and linear voltammetry on $TI/Iro_2$-$Ta_2O_5$-$MnO_x$ electrodes in sulfuric acid containing $Mn^2$ + ions", Electrochimica Acia 46 (2001) 3503-3508.

* cited by examiner

*Primary Examiner* — Bruce Bell
(74) *Attorney, Agent, or Firm* — Muncy, Geissler, Olds & Lowe, PLLC

(57) ABSTRACT

The present invention aims to provide a zinc electrowinning anode capable of inhibiting manganese compound deposition on the anode and a cobalt electrowinning anode capable of inhibiting cobalt oxyhydroxide deposition on the anode.

The zinc electrowinning anode according to the present invention is a zinc electrowinning anode having an amorphous iridium oxide-containing catalytic layer formed on a conductive substrate, and the zinc electrowinning method according to the present invention is an electrowinning method using that electrowinning anode. Also, the cobalt electrowinning anode according to the present invention is an electrowinning anode having an amorphous iridium oxide or ruthenium oxide-containing catalytic layer formed on a conductive substrate, and the cobalt electrowinning method according to the present invention is an electrowinning method using that electrowinning anode.

14 Claims, 2 Drawing Sheets

ANODE FOR USE IN ZINC AND COBALT ELECTROWINNING AND ELECTROWINNING METHOD

This application is a national stage of International Application No.: PCT/JP2009/060504, which was filed on Jun. 9, 2009, and which claims priority to Japanese Patent Application Nos.: 2008-151007, which was filed in Japan on Jun. 9, 2008, and to 2008-163714, which was filed in Japan on Jun. 23, 2008, and which are both herein incorporated by reference.

TECHNICAL FIELD

The present invention relates to the anodes for use in electrowinning of zinc and cobalt from an electrolyte and also relates to zinc and cobalt electrowinning methods.

BACKGROUND ART

In zinc electrowinning, zinc ions ($Zn^{2+}$) are extracted from a zinc ore, and an anode and a cathode are dipped into a solution (hereinafter, an electrolyte) containing the extracted zinc ions and current flows between the anode and the cathode, thereby depositing high-purity zinc on the cathode. The electrolyte is an aqueous solution typically acidified with sulfuric acid, and therefore the main reaction on the anode is oxygen evolution. However, in addition to oxygen evolution, another reaction occurs on the anode. The reaction is oxidation of divalent manganese ions ($Mn^{2+}$) contained in the electrolyte. The manganese ions are mingled into the electrolyte during the zinc ion extraction process. Specifically, in the zinc ion extraction process, the zinc ore is subjected to oxidizing roasting and then zinc ions are leached in the sulfuric acid solution, while in the roasting, some zinc contained in the zinc ore reacts with iron, thereby forming zinc ferrite. Zinc ferrite is a compound difficult to leach zinc ions from, and therefore in the course of leaching, manganese ore, manganese dioxide or potassium permanganate is added as an oxidant, thereby oxidizing and removing zinc ferrite. In this manner, zinc ferrite becomes removable, but the final sulfuric acid electrolyte having zinc ions extracted therefrom contains divalent manganese ions.

In the above-described zinc electrowinning, lead or a lead alloy is used as the anode, but for reasons such as a high oxygen evolution potential, high electric energy consumption required for oxygen evolution, and purity of zinc deposited on the cathode being reduced by lead ions dissolved from the anode, an insoluble electrode, which has a conductive substrate, such as titanium, coated with a catalytic layer containing noble metal or noble metal oxide, has been increasingly used as an anode which overcomes disadvantages as mentioned above. For example, Patent Document 1 discloses a copper electrowinning method which uses an insoluble electrode covered with an active coating containing iridium oxide. An insoluble electrode having titanium as a conductive substrate which is coated with an iridium oxide-containing catalytic layer, particularly, a catalytic layer comprising iridium oxide and tantalum oxide, has high catalytic properties and high durability with respect to oxygen evolution from an acidic aqueous solution and is used as an anode for oxygen evolution in electrogalvanizing or electrotining of steel or producing electrolytic copper foil. For example, in Patent Document 2, the present inventor discloses an oxygen evolution anode capable of inhibiting lead dioxide deposition on the anode during electrolysis as an insoluble oxygen evolution anode suitable for copper plating or electrolytic copper foil production. In recent years, application of such an insoluble anode is also under study in the field of metal electrowinning.

Also, in cobalt electrowinning, divalent cobalt ions ($Co^{2+}$) are extracted from a cobalt-containing ore, and the anode and the cathode are dipped in a solution (hereinafter, an electrolyte) containing the extracted cobalt ions and current flows between the anode and the cathode, so that high-purity cobalt is deposited on the cathode. The solution is typically an acidic aqueous solution, and typical examples of the electrolyte include a chloride-based electrolyte obtained by dissolving divalent cobalt ions in an aqueous solution containing chloride ions typically acidified with hydrochloric acid and a sulfuric acid-based electrolyte obtained by dissolving divalent cobalt ions in an aqueous solution acidified with sulfuric acid. In cobalt electrowinning, the anode and the cathode are dipped in the electrolyte, a certain amount of cobalt is deposited on the cathode, and then the cathode is removed to recover cobalt. On the other hand, in the case where a chloride-based electrolyte is used, typically, the main reaction on the anode is chlorine evolution, and in the case where a sulfuric acid-based electrolyte is used, the main reaction is oxygen evolution. However, the main reaction on the anode may vary depending on the type of reaction to which the anode has catalytic properties, and both chlorine evolution and oxygen evolution may occur.

In the above-described cobalt electrowinning, a lead-based electrode, such as lead or a lead alloy, is mainly used as an anode, which is disadvantageous, for example, in that the anode reaction occurs at high potential, hence high electric energy consumption is required for the anode reaction, and lead ions dissolved from the anode reduce the purity of cobalt deposited on the cathode. Also, in the case where the lead-based electrode is used as an anode, chlorine or oxygen evolution, the main reaction on the anode, occurs, and simultaneously, a side reaction occurs in which divalent cobalt ions contained in the electrolyte are oxidized, so that cobalt oxyhydroxide (CoOOH) is evolved on the anode, and the divalent cobalt ions in the electrolyte that should be originally reduced on the cathode through the reaction are unnecessarily consumed on the anode. On the other hand, in such cobalt oxyhydroxide deposition, reaction of cobalt ions or cobalt oxyhydroxide with the material of the lead-based electrode also occurs at the same time, so that a compound is generated on the electrode, which is known to partially contribute to stabilization of the lead-based electrode, but because divalent cobalt ions to be deposited on the cathode are decreased due to divalent cobalt ions on the anode being consumed through reaction, the side reaction is principally unnecessary if the anode itself has high durability. As an anode for overcoming the above-described disadvantages related to the lead-based electrode, an insoluble electrode is under study which includes a conductive substrate, such as titanium, coated with a catalytic layer containing noble metal or noble metal oxide. For example, Non-Patent Document 1 describes cobalt electrowinning in which an insoluble electrode is used as an anode in a chloride-based electrolyte.

PRIOR ART DOCUMENTS

Patent Documents

Patent Document 1: Japanese Laid-Open Patent Publication No. 2007-162050

Patent Document 2: Japanese Patent No. 3914162

Non-Patent Documents

Non-Patent Document 1: T. Akre, G. M. Haarberg, S. Haarberg, J. Thonstad, and O. M. Dotterud, ECS Proceedings, PV 2004-18, pp. 276-287 (2005)

Non-Patent Document 2: S. Nijjer, J. Thonstad, G. M. Haarberg, Electrochimica Acta, Vol. 46, No. 23, pp. 3503-3508 (2001)

DISCLOSURE OF THE INVENTION

Problems to be Solved by the Invention

However, zinc electrowinning has problems as described below.

Specifically, an insoluble electrode coated with an iridium oxide-containing catalytic layer is advantageous, for example, in that, because the oxygen evolution potential can be reduced compared to conventional lead electrodes and lead alloy electrodes, and durability against oxygen evolution in an acidic aqueous solution is high, it might be possible to reduce electric energy consumption for electrolysis even in metal electrowinning and also provide a long-term stable electrolysis environment. However, when such an electrode is used in zinc electrowinning, such superior properties might be lost. This is associated with oxidation reaction of divalent manganese ions contained in the electrolyte. As disclosed in Non-Patent Document 2, in the case where an insoluble anode is electrolyzed in an acidic aqueous solution of sulfuric acid as used in zinc electrowinning, if divalent manganese ions are contained in the electrolyte, manganese ions are oxidized to change from the divalent ($Mn^{2+}$) to trivalent ($Mn^{3+}$) form before oxygen evolution, and the trivalent manganese ions are changed to insoluble manganese oxyhydroxide (MnOOH) or manganese dioxide ($MnO_2$) by a subsequent chemical reaction or electrochemical reaction, and the manganese compounds are deposited on the anode. In zinc electrowinning, an electrolyte containing divalent zinc ions and divalent manganese ions is continuously supplied between the anode and the cathode, electrolysis is continuously performed until a certain amount of zinc is deposited on the cathode and needs to be recovered, and therefore the concentration of divalent manganese ions does not decrease around the anode, deposition of the manganese compounds continues on the anode along with oxygen evolution, so that the manganese compounds are accumulated on the anode. Unlike the catalytic layer of the insoluble electrode, the manganese compounds do not have high catalytic properties with respect to oxygen evolution, and therefore as the manganese compounds are deposited, the catalytic properties inherent to the insoluble electrode, which are originally high, become lower, so that the oxygen evolution potential increases, resulting in a high electrolysis voltage. Furthermore, the manganese compounds have low conductivity, and therefore, their deposition leads to uneven current distribution on the anode, causing uneven zinc deposition on the cathode, resulting in troubles such as short circuit due to zinc being dendritically grown to reach the anode. To prevent such troubles, it is necessary to suspend electrolysis at regular intervals or before zinc is deposited in a sufficient amount to be recovered, remove the anode from the electrolyte, and eliminate the manganese compounds. In such an elimination task, the surface of the catalytic layer of the anode might be partially peeled off at the same time when deposited manganese compounds are eliminated, damaging the surface of the catalytic layer, resulting in a shortened life of the anode.

As described above, in zinc electrowinning, when an insoluble electrode having an iridium oxide-containing catalytic layer formed on a conductive substrate is used as an anode, a low oxygen evolution potential is exhibited at the beginning of electrolysis, and the electrolysis voltage can be set lower compared to lead electrodes and lead alloy electrodes, but divalent manganese ions in the electrolyte are oxidized on the anode so that a manganese compound is deposited, and correspondingly the oxygen evolution potential rises, bringing up a problem where the electrolysis voltage increases, resulting in increased electric energy consumption. Also, to eliminate this action of the manganese compound, it is necessary to suspend the electrolysis and remove the manganese compound on the anode, but this brings up a problem where the continuity of the electrolysis is interrupted. Furthermore, in removing the manganese compounds, the catalytic layer is partially damaged and even the catalytic layer, together with the manganese compound, is peeled off from the insoluble electrode, bringing up a problem where durability of the insoluble electrode is reduced. Furthermore, the deposited manganese compound causes uneven current distribution on the anode, hence uneven zinc deposition on the cathode, and zinc is dendritically grown to reach the anode, thereby causing short circuit to the electrolysis cell, bringing up a problem where it becomes difficult to continue electrolysis. In addition, as electrolysis proceeds, the lead electrode or the lead alloy electrode is worn and its thickness is changed, which are reasons for changing the distance between the anode and the cathode, while the insoluble electrode has a catalytic layer resistant to dissolution, and therefore is basically advantageous in that the change in distance between the anode and the cathode is smaller, but there are possibilities where the manganese compound might be deposited and correspondingly zinc might be dendritically grown, and therefore, the distance between the anode and the cathode cannot be shortened, although in the case of the insoluble electrodes, it can be basically shortened when compared to the case where the lead-based electrode is used, bringing up a problem where the electrolysis voltage is increased due to ohmic loss in the electrolyte.

Also, cobalt electrowinning has problems as described below.

Specifically, as also described in Non-Patent Document 1, when the insoluble electrode is used as an anode, cobalt oxyhydroxide (CoOOH) is deposited on the anode, and in this case, cobalt oxyhydroxide is merely a non-conductive material for simply coating the anode, which does not contribute to improvements in the stability of the anode and, furthermore, which impairs high catalytic properties inherent to the catalytic layer of the anode with respect to chlorine or oxygen evolution, so that divalent cobalt ions in the electrolyte are unnecessarily consumed on the anode. Specifically, in cobalt electrowinning, since an electrolyte containing divalent cobalt ions is continuously supplied between the anode and the cathode and electrolysis is continuously performed until a certain amount of cobalt is deposited on the cathode and needs to be recovered, the concentration of divalent cobalt ions does not decrease around the anode and deposition of cobalt oxyhydroxide, along with chlorine or oxygen evolution, continues on the anode so that the cobalt oxyhydroxide is accumulated on the anode. In the case where only the chlorine or oxygen evolution occurs as an anode reaction, the insoluble electrode indicates a lower anode potential and higher durability compared to the lead-based electrode, but unlike the catalytic layer of the insoluble electrode, the cobalt oxyhydroxide does not have high catalytic properties with respect to oxygen or chlorine evolution, and therefore high catalytic properties inherent to the insoluble electrode become less effective as the cobalt oxyhydroxide is increasingly deposited, so that a chlorine or oxygen evolution potential rises and an electrolysis voltage increases, which might shorten the life of the anode. In addition, the cobalt oxyhydroxide has low conductivity, and therefore its deposition causes uneven current distribution on the anode, which is accompanied by uneven cobalt deposition on the cathode, resulting in troubles such as short circuit due to cobalt being dendritically grown to reach the anode. To prevent such troubles, it is necessary to suspend electrolysis at regular intervals or before a significant amount of cobalt is deposited on the cathode, remove the anode from the electrolyte, and eliminate the cobalt oxyhydroxide deposited on the anode. In such an elimination task, the surface of the catalytic layer of the anode might be partially peeled off at the same time when coherent cobalt oxyhydroxide is eliminated, damaging the surface of the catalytic layer, resulting in a shortened life of the anode.

As described above, in the case of cobalt electrowinning using an insoluble electrode which has a conductive substrate coated with a catalytic layer containing noble metal or noble metal oxide, a low anode potential is indicated at the beginning of electrolysis, so that an electrolysis voltage can be reduced compared to the lead-based electrode, but divalent cobalt ions in the electrolyte are oxidized on the anode so that cobalt oxyhydroxide is deposited, and correspondingly, the anode potential rises, which increases the electrolysis voltage, bringing up a problem where electric energy consumption increases. Also, there is a problem where divalent cobalt ions that should be originally reduced on the cathode are unnecessarily consumed on the anode. In addition, to eliminate this action of the cobalt oxyhydroxide, it is necessary to suspend the electrolysis and remove the cobalt oxyhydroxide on the anode, but this brings up a problem where the continuity of the electrolysis is interrupted. Furthermore, in removing the cobalt oxyhydroxide, the catalytic layer is partially damaged and even the catalytic layer, together with the cobalt oxyhydroxide, is peeled off from the insoluble electrode, bringing up a problem where durability of the insoluble electrode is reduced. Furthermore, the deposited cobalt oxyhydroxide causes uneven current distribution on the anode, hence uneven cobalt deposition on the cathode, resulting in cobalt being dendritically grown to reach the anode, thereby causing short circuit to the electrolysis cell, bringing up a problem where it becomes difficult to continue electrolysis. In addition, as electrolysis proceeds, the lead electrode or the lead alloy electrode is worn and its thickness is changed, which are reasons for changing the distance between the anode and the cathode, while the insoluble electrode has a catalytic layer resistant to dissolution, and therefore is basically advantageous in that the change in distance between the anode and the cathode is smaller, but there are possibilities where the cobalt oxyhydroxide might be deposited and correspondingly cobalt might be dendritically grown, and therefore, the distance between the anode and the cathode cannot be shortened, although in the case of the insoluble electrodes, it can be basically shortened when compared to the case where the lead-based electrode is used, bringing up a problem where the electrolysis voltage is increased due to ohmic loss in the electrolyte.

In view of the problems mentioned above, the present invention aims to provide an anode for use in electrowinning of zinc on a cathode by electrolysis from an aqueous solution containing divalent zinc ions, the anode having a low oxygen evolution potential and being capable of inhibiting manganese compound deposition on the anode by electrolysis, and the present invention also aims to provide a zinc electrowinning method allowing inhibition of manganese compound deposition on an anode during electrowinning.

Furthermore, the present invention aims to provide an anode for use in electrowinning of cobalt on a cathode by electrolysis from an aqueous solution containing divalent cobalt ions, the anode having a low potential for chlorine and/or oxygen evolution on the anode and being capable of inhibiting cobalt oxyhydroxide deposition on the anode by electrolysis, and the present invention also aims to provide a cobalt electrowinning method allowing inhibition of cobalt oxyhydroxide deposition on an anode during electrowinning.

Solution to the Problems

The present inventor carried out various studies to solve the above problems related to zinc electrowinning, and arrived at the present invention based on findings that manganese compound deposition on an electrowinning anode is inhibited by using an amorphous iridium oxide-containing catalytic layer.

Specifically, the present invention provides a zinc electrowinning anode for use in zinc electrowinning, including a conductive substrate and a catalytic layer formed on the conductive substrate, the catalytic layer containing amorphous iridium oxide. Here, suitable conductive substrates are valve metals, such as titanium, tantalum, zirconium and niobium, valve metal-based alloys, such as titanium-tantalum, titanium-niobium, titanium-palladium and titanium-tantalum-niobium, and conductive diamonds (e.g., boron-doped diamonds), and various shapes can be taken, including plate-like, meshed, rod-like, sheet-like, tubular, linear, porous plate-like shapes, and shapes of three-dimensional porous materials composed of bonded spherical metal particles. Also, the aforementioned metals, alloys and conductive diamonds may be used to coat surfaces of metals other than valve metals, such as iron and nickel, or surfaces of conductive ceramics.

When compared to crystalline iridium oxide, amorphous iridium oxide in the catalytic layer has higher catalytic activity for oxygen evolution and therefore has a low overpotential for oxygen evolution, so that oxygen is evolved at lower potentials. The present inventor found that the action of promoting oxygen evolution is effective in inhibiting manganese compound deposition on the anode. Specifically, divalent manganese ions, when oxidized, turn to trivalent manganese ions and then react with water to turn to manganese oxyhydroxide (MnOOH). When manganese oxyhydroxide is further oxidized, it turns to manganese dioxide ($MnO_2$). Both manganese oxyhydroxide deposition and manganese dioxide deposition involve evolution of protons ($H^+$). In particular, as for a chemical reaction in which manganese oxyhydroxide and protons are produced from trivalent manganese ions and water, when the pH of an aqueous solution in which this reaction occurs is low (i.e., the concentration of protons is high), the reaction is relatively inhibited, whereas the reaction is promoted when the pH is high (i.e., the concentration of protons is low). On the other hand, while oxygen evolution is a reaction caused by water being oxidized to generate oxygen, protons are also produced at the same time. Here, considering a case where electrowinning is performed with constant current, in oxygen evolution and manganese compound deposition that could simultaneously occur on the same anode, the current can be shared between oxygen evolution and the reaction in which divalent manganese ions turn to trivalent or tetravalent manganese ions ($Mn^{4+}$), but when oxygen evolution is promoted, the current is more consumed by oxygen evolution. In this manner, manganese compound deposition on an amorphous iridium oxide-containing catalytic layer can be inhibited by promoting oxygen evolution such that the current is more consumed by oxygen evolution than by oxidation of divalent manganese ions, and furthermore, such promotion of oxygen evolution causes an increase in proton concentration on the anode surface, which also inhibits manganese compound deposition. Such a mode of action in which amorphous iridium oxide inhibits manganese compound deposition is a new finding by the present inventor as will be described below.

The present inventor already disclosed in Patent Document 2 that, when an electrode for oxygen evolution, which has an amorphous iridium oxide-containing catalytic layer formed on a conductive substrate, is used as an anode for electrolytic copper plating or electrolytic copper foil production, it is possible to inhibit lead dioxide deposition which occurs simultaneously with oxygen evolution on the anode. The mode of action for inhibiting lead dioxide deposition by amorphous iridium oxide is due to an amorphous iridium oxide-containing catalytic layer needing a large energy to crystallization of lead dioxide with respect to a reaction in which lead dioxide is deposition. Specifically, a reaction in which lead dioxide is deposited at the same time as oxygen evolution in an electrolyte containing divalent lead ions ($Pb^{2+}$) consists of two steps: an electrochemical reaction in which divalent lead ions are oxidized to become tetravalent lead ions ($Pb^{4+}$) and, at the same time, react with water to become amorphous lead dioxide; and a crystallization reaction in which amorphous lead dioxide changes to crystalline lead dioxide. Here, iridium oxide and lead dioxide belong to the same crystal group and have similar crystallographic structures, and therefore the aforementioned crystallization reaction of lead dioxide readily progresses on the insoluble anode having the crystalline iridium oxide-containing catalytic layer, so that crystallized lead dioxide is deposited on the catalytic layer and then firmly attached and accumulated. On the other hand, lead dioxide crystallization on the amorphous iridium oxide requires significant energy, and therefore the aforementioned crystallization reaction of lead dioxide does not readily progress. According to generally-known chemical reaction kinetics, when the entire reaction consists of two consecutive steps, it is apparent that, if either the first or second step is very slow, the entire reaction is unlikely to progress, and in fact, the present inventor already demonstrated that energy (crystallization energy) required for the aforementioned lead dioxide crystallization is considerably higher for amorphous iridium oxide than for crystalline iridium oxide.

On the other hand, in the present invention, it was found that deposition of divalent manganese ions as manganese compounds can be inhibited in the amorphous iridium oxide-containing catalytic layer. Manganese oxyhydroxide, which is a manganese compound to be generated first, is an amorphous product unlike lead dioxide which is crystalline. That is, the process of manganese oxyhydroxide deposition involves no crystallization reaction. To inhibit this, it is necessary to slow progression of an electrochemical reaction of manganese ions from the divalent to trivalent form or slow progression of a subsequent chemical reaction of trivalent manganese ions with water, but the reactivity of the electrochemical reaction involving charge transfer greatly depends on the constituents of the catalytic layer themselves, and therefore, in the case where iridium oxide is used, it becomes difficult to control the reaction rate of the electrochemical reaction depending on the difference between crystalline and amorphous structures. On the other hand, as for the chemical reaction, which follows the electrochemical reaction, according to the principle of chemical equilibrium, when the concentration of any chemical species contained in the chemical reaction increases, the chemical reaction progresses to reduce the concentration of the chemical species. Specifically, in the chemical reaction in which manganese oxyhydroxide is deposited, manganese oxyhydroxide and protons are produced from trivalent manganese ions and water, and in this case, if another reaction results in conditions for increasing protons, manganese oxyhydroxide deposition is inhibited.

In the present invention, the mode of action for achieving such an increase in protons using the amorphous iridium oxide-containing catalytic layer is established as shown below. When compared to the crystalline iridium oxide containing-catalytic layer, the amorphous iridium oxide-containing catalytic layer has an increased effective surface area due to amorphization of iridium oxide. The effective surface area is not a geometric area but a substantial "reactive surface area" determined by an active site where oxygen evolution occurs. Also, amorphization enhances catalytic properties for oxygen evolution with reference to the active site. Such an increase in effective surface area and enhanced catalytic properties with reference to the active site promote oxygen evolution. Accordingly, even in the case where the catalytic layers are equal in geometric area, oxygen evolution is more promoted by amorphous iridium oxide than by crystalline iridium oxide, so that proton evolution accompanied by oxygen evolution is more promoted. The reactions occur on the surface of the catalytic layer where the catalytic layer is in contact with the electrolyte, and therefore the concentration of protons is dramatically increased on the surface of the amorphous iridium oxide-containing catalytic layer compared to the surface of the crystalline iridium oxide-containing catalytic layer. With the increase in proton concentration on the surface of the catalytic layer, more current is consumed by oxygen evolution than by manganese ion oxidation from the divalent to trivalent ions, so that manganese oxyhydroxide deposition is effectively inhibited. This inhibiting action is obviously affected by the concentration of protons in the electrolyte and the concentration of trivalent manganese ions to be generated, in other words, the concentration of divalent manganese ions initially present in the electrolyte, but in the present invention, it was found that manganese oxyhydroxide deposition is effectively inhibited even in an electrolyte with high concentrations of divalent manganese ions and protons, where the above inhibiting action is unlikely to occur. As described above, the present invention is based on a newly found mode of action for the electrowinning anode having an amorphous iridium oxide-containing catalytic layer formed on a conductive substrate, and therefore substantially differs from the invention of Patent Document 2 disclosed earlier by the present inventor, and it would have been difficult to readily find inhibition of manganese compound deposition through the mode of action of the present invention. It is noted that while Patent Document 1 discloses a method for preventing a short-circuit accident due to dendritic growth of a non-conducting material being unevenly deposited on part of an insoluble electrode used as an anode when current is stopped during metal electrowinning, thereby causing current concentration in an area without deposition of any non-conducting material when current is applied again, still the intended non-conducting material is antimony, the deposition occurs when electrolysis is stopped, and its prevention method is to use an anode having its surfaces coated with an anode material as a catalytic layer only in areas to be located below the surface of an electrolyte when only the anode is dipped in the electrolyte, which makes it obvious that the material to be prevented from being deposited, the mechanism of the deposition of the material, and the solution to prevent the deposition are all different from those of the present invention, and the present invention would not have been arrived at from the disclosure of Patent Document 1.

Hereinafter, the contents of the present invention will be described in further detail. As methods for forming an amorphous iridium oxide-containing catalytic layer on a conductive substrate, various physical and chemical vapor deposition methods, such as sputtering and CVD, can be used in addition to a thermal decomposition method in which a precursor solution containing iridium ions is applied to the conductive substrate and then thermally treated at a predetermined temperature. Here, among the methods for producing the electrowinning anode of the present invention, in particular, a production method through thermal decomposition will be further described. For example, a butanol solution having iridium ions dissolved therein is applied to a titanium substrate and then decomposed by heat at a temperature from 340° C. to 400° C., resulting in an amorphous iridium oxide-containing catalytic layer being formed on the titanium substrate. In addition, when a butanol solution having iridium and tantalum ions dissolved therein is applied to the titanium substrate and thermally decomposed, for example, if the mole ratio of iridium to tantalum in the butanol solution is 80:20 and the thermal decomposition temperature is in the range from 340° C. to 420° C., an amorphous iridium oxide-containing catalytic layer composed of iridium oxide and tantalum oxide is formed, and for example, if the mole ratio of iridium to tantalum in the butanol solution is 50:50, an amorphous iridium oxide-containing catalytic layer composed of iridium oxide and tantalum oxide is formed within a wider range of thermal decomposition temperatures from 340° C. to 470° C. In this manner, in the method for forming an amorphous iridium oxide-containing catalytic layer on a conductive substrate through thermal decomposition, the catalytic layer contains or does not contain amorphous iridium oxide depending on, for example, a metallic constituent of the solution to be applied to the titanium substrate, the composition of the metallic constituent, and the thermal decomposition temperature. In this case, when another solution has the same constituents of the solution to be applied, excluding any metallic constituent, and also has two metallic constituents, such as iridium and tantalum, if the mole ratio of iridium in the solution is lower, as described above, the range of thermal decomposition temperatures at which amorphous iridium oxide can be obtained becomes wider. Furthermore, the conditions in which to form an amorphous iridium oxide-containing catalytic layer change depending not only on the compositional proportion of such a metallic constituent but also on the type of solvent used in the solution to be applied and the type and concentration of an additive to be provided to a solution for promoting thermal decomposition. Accordingly, in the present invention, the conditions in which to form an amorphous iridium oxide-containing catalytic layer are not limited to the use of a butanol solvent in the aforementioned thermal decomposition, the compositional proportions of iridium and tantalum, and the related thermal decomposition temperature range. Note that evolution of amorphous iridium oxide can be recognized by whether no diffraction peak profile corresponding to crystalline iridium oxide is observed or such a peak profile is weakened or broadened through commonly used X-ray diffractometry.

Also, the present invention provides a zinc electrowinning anode with a catalytic layer containing amorphous iridium oxide and metal oxide selected from among titanium, tantalum, niobium, tungsten and zirconium. By adding the metal oxide selected from among titanium, tantalum, niobium, tungsten and zirconium to the amorphous iridium oxide, the iridium oxide is inhibited, for example, from wearing and from peeling/coming off the conductive substrate, thereby preventing embrittlement of the catalytic layer, making it possible to produce the effect of enhancing electrode durability. In this case, the metallic elements in the catalytic layer are preferably 45 to 99 at. %, particularly preferably 50 to 95 at. %, of iridium oxide in terms of metal and preferably 55 to 1 at. %, particularly preferably 50 to 5 at. %, of metal oxide to be mixed with iridium oxide in terms of metal.

The present invention also provides a zinc electrowinning anode with a catalytic layer containing amorphous iridium oxide and amorphous tantalum oxide. When the catalytic layer contains amorphous tantalum oxide along with amorphous iridium oxide, the tantalum oxide functions to enhance dispersibility of iridium oxide in the catalytic layer and nanoparticulate iridium oxide, and also functions as a binder to enhance compactibility of the catalytic layer compared to the case where iridium oxide is used alone, making it possible to produce the effect of reducing overpotential for oxygen evolution and enhancing durability. Also, the amorphous tantalum oxide functions to promote amorphization of iridium oxide.

The present invention also provides a zinc electrowinning anode with a catalytic layer containing amorphous iridium oxide, crystalline iridium oxide, and amorphous tantalum oxide. The catalytic layer contains a mix of crystalline iridium oxide with amorphous iridium oxide, and therefore the crystalline iridium oxide produces an anchor effect to enhance adherence of the catalytic layer to a conductive substrate, thereby inhibiting embrittlement of the amorphous iridium oxide, making it possible to produce the effect of reducing wearing of iridium oxide. Also, when the amorphous tantalum oxide is mixed together with the above oxides, the amorphous tantalum oxide binds the crystalline iridium oxide to the amorphous iridium oxide, thereby inhibiting the entire catalytic layer from wearing, peeling, flaking and cracking, making it possible to produce the effect of enhancing durability of the catalytic layer.

The present invention also provides a zinc electrowinning anode with a corrosion-resistant intermediate layer provided between a conductive substrate and a catalytic layer. Here, for example, but not limited to, tantalum or an alloy thereof is suitable for the corrosion-resistant intermediate layer, and an acidic electrolyte permeating through the catalytic layer during long-term use prevents oxidation/corrosion of the conductive substrate, making it possible to produce the effect of enhancing durability of the electrowinning anode. As methods for forming the intermediate layer, sputtering, ion plating, CVD, electroplating, etc., are used.

The present invention also provides a zinc electrowinning method in which electrolysis is performed using any of the electrowinning anodes mentioned above.

While the present invention has been described with respect to the electrowinning anodes for use in zinc electrowinning and the zinc electrowinning processes using electrolytes containing divalent zinc ions extracted from a zinc ore, the invention is obviously useful in a recycle or recovery process in which high-purity zinc is produced through any of the above processes and used for various purposes in various applications, and the used zinc is recovered to extract divalent zinc ions again and produce high-purity zinc through electrolysis.

Also, the present inventor conducted various studies to solve the aforementioned problems with cobalt electrowinning, and arrived at the present invention by finding that the use of an amorphous, i.e., low-crystallinity, iridium oxide or ruthenium oxide-containing catalytic layer inhibits cobalt oxyhydroxide deposition on a cobalt electrowinning anode.

Specifically, the present invention provides a cobalt electrowinning anode for use in cobalt electrowinning, including a conductive substrate and a catalytic layer formed on the conductive substrate, the catalytic layer containing amorphous iridium oxide or ruthenium oxide. Here, suitable conductive substrates are valve metals, such as titanium, tantalum, zirconium and niobium, valve metal-based alloys, such as titanium-tantalum, titanium-niobium, titanium-palladium and titanium-tantalum-niobium, and conductive diamonds (e.g., boron-doped diamonds), and various shapes can be taken, including plate-like, meshed, rod-like, sheet-like, tubular, linear, porous plate-like shapes, and shapes of three-dimensional porous materials composed of bonded spherical metal particles. Also, the aforementioned metals, alloys and conductive diamonds may be used to coat surfaces of metals other than valve metals, such as iron and nickel, or surfaces of conductive ceramics.

Next, the cobalt electrowinning anode according to the present invention will be described in further detail with respect to the action of the catalytic layer. First, in the case where the catalytic layer contains amorphous iridium oxide, when compared to crystalline iridium oxide, amorphous iridium oxide has higher catalytic activity for oxygen evolution and therefore has a low overpotential for oxygen evolution so that oxygen is evolved at lower potentials. The present inventor found that the action of promoting oxygen evolution is effective in inhibiting deposition of cobalt oxyhydroxide on the anode. Specifically, divalent cobalt ions, when oxidized, turn to trivalent cobalt ions ($Co^{3+}$) and then react with water to turn to cobalt oxyhydroxide. Deposition of cobalt oxyhydroxide involves evolution of protons ($H^+$). As for chemical reaction in which cobalt oxyhydroxide and protons are generated from trivalent cobalt ions and water, when the pH of an aqueous solution in which this reaction occurs is low (i.e., the concentration of protons is high), the reaction is relatively inhibited, whereas the reaction is promoted when the pH is high (i.e., the concentration of protons is low). On the other hand, while oxygen evolution is a reaction caused by water being oxidized to generate oxygen, protons are also evolved at the same time. That is, promotion of oxygen evolution on the anode increases the proton concentration on the anode surface. Furthermore, considering a case where electrowinning is performed with constant current, in oxygen evolution and cobalt oxyhydroxide deposition that could simultaneously occur on the same anode, the current can be shared between oxygen evolution and the reaction in which divalent cobalt ions turn to trivalent cobalt ions, but when oxygen evolution is promoted, the current is more consumed by oxygen evolution. In this manner, cobalt oxyhydroxide deposition on an amorphous iridium oxide-containing catalytic layer can be inhibited by promoting oxygen evolution such that the current is more consumed by oxygen evolution than by cobalt oxyhydroxide deposition, and furthermore, such promotion of oxygen evolution causes an increase in proton concentration on the anode surface, which also inhibits cobalt oxyhydroxide deposition.

The aforementioned mode of action will be further described with respect to the relationship with the type of electrolyte. First, there are two typical electrolytes for use in cobalt electrowinning, i.e., sulfuric acid- and chloride-based electrolytes, and in the case of the sulfuric acid-based electrolyte, the main reaction on the anode is oxygen evolution, so cobalt oxyhydroxide deposition is inhibited by the aforementioned mode of action. On the other hand, in the case of the chloride-based electrolyte, the main reaction on the anode is typically chlorine evolution, but when an iridium oxide-containing catalytic layer is used in the anode, oxygen evolution also occurs at the same time as chlorine evolution since iridium oxide has high catalytic activity for oxygen evolution. Specifically, when an anode having an amorphous iridium oxide-containing catalytic layer is used in cobalt electrowinning in which a chloride-based electrolyte is used, not only chlorine evolution but also oxygen evolution occur, and oxygen evolution is more promoted than in the case of crystalline iridium oxide, so that proton evolution, which, basically, is not caused to occur simply by chlorine evolution reaction, occurs on the anode surface, and the proton concentration on the anode surface is considerably increased compared to the case where crystalline iridium oxide is used. In this manner, also in cobalt electrowinning using not only the sulfuric acid-based electrolyte but also the chloride-based electrolyte, the anode of the present invention, which has an amorphous iridium oxide-containing catalytic layer, has the effect of inhibiting cobalt oxyhydroxide deposition.

Next, the cobalt electrowinning anode according to the present invention will be described in further detail with respect to the action of the amorphous ruthenium oxide-containing catalytic layer. When compared to the crystalline ruthenium oxide, the amorphous ruthenium oxide has higher catalytic activity for chlorine evolution, and therefore has a low overpotential for chlorine evolution so that chlorine is evolved at lower potentials. The present inventor found that the action of promoting chlorine evolution is effective in inhibiting cobalt oxyhydroxide deposition on the anode. However, the mode of action differs from that for the anode having an amorphous iridium oxide-containing catalytic layer. Specifically, when the anode having a ruthenium oxide-containing catalytic layer is used in a chloride-based electrolyte, less oxygen evolution occurs unlike in the case of iridium oxide. Accordingly, the mode of action in which cobalt oxyhydroxide deposition is inhibited by promotion of proton evolution accompanied by oxygen evolution on the anode does not apply to the anode having a ruthenium oxide-containing catalytic layer. However, the present inventor found that the amorphous ruthenium oxide promotes chlorine evolution considerably more compared to the crystalline ruthenium oxide, and such promotion has the effect of inhibiting cobalt oxyhydroxide deposition on the anode. Such a mode of action is considerably associated with a decrease in ratio of current consumed by cobalt oxyhydroxide deposition. Specifically, considering a case where cobalt electrowinning is performed with constant current, in chlorine evolution and cobalt oxyhydroxide deposition that could simultaneously occur on the same anode, the current can be shared between chlorine evolution and the reaction in which divalent cobalt ions turn to trivalent cobalt ions, but when chlorine evolution is promoted, the current is more consumed by chlorine evolution. In this manner, conceivably, cobalt oxyhydroxide deposition on the amorphous ruthenium oxide-containing catalytic layer can be inhibited by promoting chlorine evolution such that the current is more consumed by chlorine evolution than by cobalt oxyhydroxide deposition. Note that oxygen evolution occurs when the anode having an amorphous ruthenium oxide-containing catalytic layer is used in the sulfuric acid-based electrolyte, so that cobalt oxyhydroxide deposition is inhibited by the same mode of action as in the case where the anode having an amorphous iridium oxide-containing catalytic layer is used, but the anode having a catalytic layer mainly composed of amorphous iridium oxide, rather than amorphous ruthenium oxide, is more suitable for the sulfuric acid-based electrolyte because of its superior durability.

The mode of action in which cobalt oxyhydroxide deposition is inhibited by the anode having a amorphous iridium or ruthenium oxide-containing catalytic layer formed on a conductive substrate, as described above, is based on the present inventor's new findings as will be described below. The present inventor already disclosed in Patent Document 2 that, when an electrode for oxygen evolution, which has an amorphous iridium oxide-containing catalytic layer formed on a conductive substrate, is used as an anode for electrolytic copper plating or electrolytic copper foil production, it is possible to inhibit lead dioxide deposition which simultaneously occurs with oxygen evolution on the anode. The mode of action for inhibiting evolution of lead dioxide by amorphous iridium oxide is due to an amorphous iridium oxide-containing catalytic layer needing a large energy of crystallization of lead dioxide with respect to a reaction in which lead dioxide is deposited. Specifically, a reaction in which lead dioxide is deposited at the same time as oxygen evolution in an electrolyte containing divalent lead ions consists of two steps: an electrochemical reaction in which divalent lead ions are oxidized to become tetravalent ions and, at the same time, react with water to become amorphous lead dioxide; and a crystallization reaction in which amorphous lead dioxide changes to crystalline lead dioxide. Here, iridium oxide and lead dioxide belong to the same crystal group and have similar crystallographic structures, and therefore the aforementioned crystallization reaction readily progresses on the crystalline iridium oxide-containing catalytic layer, so that crystallized lead dioxide is deposited on the catalytic layer and then firmly attached and accumulated. On the other hand, lead dioxide crystallization on the amorphous iridium oxide-containing catalytic layer requires significant energy, and therefore the aforementioned crystallization reaction does not readily progress. According to generally-known chemical reaction kinetics, when the entire reaction consists of two consecutive steps, it is apparent that, if either the first or second reaction is very slow, the entire reaction is unlikely to progress, and in fact, the present inventor already demonstrated that energy (crystallization energy) required for the aforementioned lead dioxide crystallization is considerably higher for amorphous iridium oxide than for crystalline iridium oxide.

On the other hand, in the present invention, it was found that deposition of divalent cobalt ions as cobalt oxyhydroxide can be inhibited on the amorphous iridium oxide-containing catalytic layer. Here, unlike lead dioxide, cobalt oxyhydroxide is not a crystalline product but an amorphous product. That is, the process of cobalt oxyhydroxide deposition involves no crystallization reaction. To inhibit this, it is necessary to slow progression of an electrochemical reaction of cobalt ions from the divalent to trivalent form or slow progression of a subsequent chemical reaction of trivalent cobalt ions with water, but the reactivity of the electrochemical reaction involving charge transfer greatly depends on the constituents of the catalytic layer themselves, and therefore, in the case where iridium oxide is used, it becomes difficult to control the reaction rate of the electrochemical reaction depending on the difference between crystalline and amorphous structures. On the other hand, as for the chemical reaction, which follows the electrochemical reaction, according to the principle of chemical equilibrium, when the concentration of any chemical species contained in the chemical reaction increases, the chemical reaction progresses to reduce the concentration of the chemical species. Specifically, in the chemical reaction in which cobalt oxyhydroxide is deposited, cobalt oxyhydroxide and protons are generated from trivalent cobalt ions and water, and in this case, if another reaction results in conditions for increasing protons, cobalt oxyhydroxide deposition is inhibited.

In the present invention, the mode of action for achieving such an increase in protons using amorphous iridium oxide is established as shown below. Due to amorphization of iridium oxide, the amorphous iridium oxide-containing catalytic layer has an increased effective surface area compared to the crystalline iridium oxide containing-catalytic layer. The effective surface area is not a geometric area but a substantial "reactive surface area" determined by an active site where oxygen evolution occurs. Also, amorphization enhances catalytic properties for oxygen evolution with reference to the active site. Such an increase in effective surface area and enhanced catalytic properties with reference to the active site promote oxygen evolution. Accordingly, even in the case where the catalytic layers are equal in geometric area, oxygen evolution is more promoted by amorphous iridium oxide than by crystalline iridium oxide, so that proton generation accompanied by oxygen evolution is more promoted. The reactions occur on the surface of the catalytic layer where the catalytic layer is in contact with the electrolyte, and therefore the concentration of protons is dramatically increased on the surface of the amorphous iridium oxide-containing catalytic layer compared to the surface of the crystalline iridium oxide-containing catalytic layer. With the increase in proton concentration on the surface of the catalytic layer, more current is consumed by oxygen evolution than by cobalt ion oxidation from the divalent to trivalent ions, so that any chemical reaction in cobalt oxyhydroxide deposition is effectively inhibited. This inhibiting action is obviously affected by the concentration of protons in the electrolyte and the concentration of trivalent cobalt ions to be evolved, in other words, the concentration of divalent cobalt ions initially present in the electrolyte, but in the present invention, it was found that cobalt oxyhydroxide deposition is effectively inhibited even in an electrolyte with high concentrations of divalent cobalt ions and protons, where the above inhibiting action is unlikely to occur.

Furthermore, in the present invention, it was found that, when the anode having an amorphous ruthenium oxide-containing catalytic layer is used in a chloride-based electrolyte, promotion of chlorine evolution effectively inhibits cobalt oxyhydroxide deposition even on the amorphous ruthenium oxide-containing catalytic layer, which does not involve an increase in crystallization energy and an increase in protons as achieved on the amorphous iridium oxide-containing catalytic layer. It was also found that, in the case where the anode having an amorphous ruthenium oxide-containing catalytic layer is used in a sulfuric acid-based electrolyte, cobalt oxyhydroxide deposition is effectively inhibited by the same mode of action as in the case where the anode having an amorphous iridium oxide-containing catalytic layer is used. Note that the cobalt electrowinning anode of the present invention obviously encompasses an anode having a catalytic layer containing both amorphous iridium oxide and amorphous ruthenium oxide formed on a conductive substrate.

As described above, the present invention is based on a newly found mode of action for the cobalt electrowinning anode having an amorphous iridium oxide or ruthenium oxide-containing catalytic layer formed on a conductive substrate, and therefore substantially differs from the invention of Patent Document 2 disclosed earlier by the present inventor, and basically, it would have been difficult to readily find inhibition of cobalt oxyhydroxide deposition through the mode of action of the present invention. Note that the disclosed invention of Patent Document 1 is a method for preventing a short-circuit accident due to dendritic growth of a non-conducting material being unevenly deposited on part of a dimensionally stable electrode used as an anode when current is stopped during metal electrowinning, thereby causing current concentration in an area without deposition of any non-conducting material when current is applied again, but the intended non-conducting material is antimony, the deposition occurs when electrolysis is stopped, and its prevention method is to use an anode having its surfaces coated with an anode material as a catalytic layer only in areas to be located below the surface of an electrolyte when only the anode is dipped in the electrolyte, which makes it obvious that the material to be prevented from being deposited, the mechanism of depositing the material, and the solution to prevent the deposition are all different from those of the present invention, and the present invention would not have been arrived at from the disclosure of Patent Document 1.

Hereinafter, the contents of the present invention will be described in further detail. As methods for forming an amorphous iridium oxide or ruthenium oxide-containing catalytic layer on a conductive substrate, various physical and chemical vapor deposition methods, such as sputtering and CVD, can be used in addition to a thermal decomposition method in which a precursor solution containing iridium ions or ruthenium ions or a ruthenium-containing compound is applied to the conductive substrate and then thermally treated at a predetermined temperature.

Here, among the methods for producing the cobalt electrowinning anode of the present invention, in particular, a production method through thermal decomposition will be further described. For example, a butanol solution having iridium ions dissolved therein is applied to a titanium substrate and then decomposed by heat at a temperature from 340° C. to 400° C., resulting in an amorphous iridium oxide-containing catalytic layer being formed on the titanium substrate. In addition, when a butanol solution having iridium and tantalum ions dissolved therein is applied to the titanium substrate and thermally decomposed, for example, if the mole ratio of iridium to tantalum in the butanol solution is 80:20 and the thermal decomposition temperature is in the range from 340° C. to 400° C., an amorphous iridium oxide-containing catalytic layer composed of iridium oxide and tantalum oxide is formed, and for example, if the mole ratio of iridium to tantalum in the butanol solution is 50:50, an amorphous iridium oxide-containing catalytic layer composed of iridium oxide and tantalum oxide is formed within a wider range of thermal decomposition temperatures from 340° C. to 470° C. In this manner, in the method for forming an amorphous iridium oxide-containing catalytic layer on a conductive substrate through thermal decomposition, the catalytic layer contains or does not contain amorphous iridium oxide depending on, for example, a metallic constituent of the solution to be applied to the titanium substrate, the composition of the metallic constituent, and the thermal decomposition temperature. In this case, when another solution has the same constituents of the solution to be applied, excluding any metallic constituent, and also has two metallic constituents, such as iridium and tantalum, if the compositional proportion of iridium in the solution is lower, as described above, the range of thermal decomposition temperatures at which amorphous iridium oxide can be obtained becomes wider. Furthermore, the conditions in which to form an amorphous iridium oxide-containing catalytic layer change depending not only on the compositional proportion of such a metallic constituent but also on the type of solvent used in the solution to be applied and the type and concentration of an additive to be provided to a solution for promoting thermal decomposition. Accordingly, in the present invention, the conditions in which to form an amorphous iridium oxide-containing catalytic layer are not limited to the use of a butanol solvent in the aforementioned thermal decomposition, the compositional proportions of iridium and tantalum, and the related thermal decomposition temperature range. Note that generation of amorphous iridium oxide can be recognized by whether no diffraction peak profile corresponding to crystalline iridium oxide is observed or such a peak profile is weakened or broadened through commonly used X-ray diffractometry.

Furthermore, among the methods for producing the cobalt electrowinning anode of the present invention, a method in which an amorphous ruthenium oxide-containing catalytic layer is formed on a conductive substrate formed through thermal decomposition will be described. For example, a butanol solution having ruthenium ions or a ruthenium-containing compound dissolved therein is applied to a titanium substrate and then thermally decomposed at 360° C., resulting in an amorphous ruthenium oxide-containing catalytic layer being formed on the titanium substrate. In addition, when a butanol solution having ruthenium ions or a ruthenium-containing compound dissolved therein, together with titanium ions or a titanium-containing compound, is applied to the titanium substrate and thermally decomposed, for example, if the mole ratio of ruthenium to titanium in the butanol solution is 30:70 and the thermal decomposition temperature is in the range from 340° C. to 400° C., an amorphous ruthenium oxide-containing catalytic layer composed of ruthenium and titanium composite oxide is formed. In this manner, in the method for forming an amorphous ruthenium oxide-containing catalytic layer on a conductive substrate through thermal decomposition, the catalytic layer contains or does not contain amorphous ruthenium oxide depending on, for example, a metallic constituent of the solution to be applied to the titanium substrate, the composition of the metallic constituent, and the thermal decomposition temperature. Furthermore, the conditions in which to form an amorphous ruthenium oxide-containing catalytic layer change depending not only on the compositional proportion of such a metallic constituent but also on the type of solvent used in the solution to be applied and the type and concentration of an additive to be provided to a solution for promoting thermal decomposition. Accordingly, in the present invention, the conditions in which to form an amorphous ruthenium oxide-containing catalytic layer are not limited to the use of a butanol solvent in the aforementioned thermal decomposition, the compositional proportions of ruthenium and titanium, and the related thermal decomposition temperature range. Note that generation of amorphous ruthenium oxide can be recognized by whether no diffraction peak profile corresponding to crystalline ruthenium oxide is observed or such a peak profile is weakened or broadened through commonly used X-ray diffractometry.

Also, the present invention provides a cobalt electrowinning electrode with a catalytic layer containing amorphous iridium oxide and metal oxide selected from among titanium, tantalum, niobium, tungsten and zirconium. By adding the metal oxide selected from among titanium, tantalum, niobium, tungsten and zirconium to the amorphous iridium oxide, the iridium oxide is inhibited, for example, from wearing and from peeling/coming off the conductive substrate, thereby preventing embrittlement of the catalytic layer, making it possible to produce the effect of enhancing electrode durability. In this case, the metallic elements in the catalytic layer are preferably 45 to 99 at. %, particularly preferably 50 to 95 at. %, of iridium oxide in terms of metal and preferably 55 to 1 at. %, particularly preferably 50 to 5 at of metal oxide to be mixed with iridium oxide in terms of metal.

The present invention also provides a cobalt electrowinning anode with a catalytic layer containing amorphous iridium oxide and amorphous tantalum oxide. When the catalytic layer contains amorphous tantalum oxide along with amorphous iridium oxide, the tantalum oxide enhances dispersibility of iridium oxide in the catalytic layer, and also functions as a binder to enhance compactibility of the catalytic layer compared to the case where iridium oxide is used alone, making it possible to produce the effect of reducing overpotential for oxygen evolution while enhancing durability. Also, the amorphous tantalum oxide has the effect of promoting amorphization of iridium oxide.

The present invention also provides a cobalt electrowinning anode with a catalytic layer containing amorphous ruthenium oxide and titanium oxide. When the catalytic layer contains titanium oxide along with amorphous ruthenium oxide, the titanium oxide promotes amorphization of ruthenium oxide in the catalytic layer, and also functions as a binder to inhibit the entire catalytic layer from wearing, peeling, flaking and cracking compared to the case where ruthenium oxide is used alone, making it possible to produce the effect of further reducing overpotential for chlorine evolution while enhancing durability.

The present invention also provides a cobalt electrowinning anode with a corrosion-resistant intermediate layer provided between a conductive substrate and a catalytic layer. Here, for example, but not limited to, tantalum or an alloy thereof is suitable for the corrosion-resistant intermediate layer, and an acidic electrolyte permeating through the catalytic layer during long-term use prevents oxidation/corrosion of the conductive substrate, making it possible to produce the effect of enhancing durability of the electrowinning anode. As methods for forming the intermediate layer, sputtering, ion plating, CVD, electroplating, etc., are used.

The present invention also provides a cobalt electrowinning method in which electrolysis is performed using any of the cobalt electrowinning anodes mentioned above.

Also, in the cobalt electrowinning method of the present invention, a chloride-based electrolyte is used or electrolysis is performed using a sulfuric acid-based electrolytic bath. Here, both the chloride-based electrolyte and the sulfuric acid-based electrolyte include electrolytes generally used in cobalt electrowinning, the chloride-based electrolyte being an electrolyte containing at least divalent cobalt ions and chloride ions and having its pH adjusted to be acidic, the sulfuric acid-based electrolyte being an electrolyte containing at least divalent cobalt ions and sulfuric acid ions and having its pH adjusted to be acidic. When cobalt electrowinning is performed using an electrowinning anode having an amorphous iridium oxide-containing catalytic layer formed on a conductive substrate in the chloride-based electrolyte, oxygen evolution on the anode is promoted as described earlier, thereby inhibiting cobalt oxyhydroxide deposition. Also, when cobalt electrowinning is performed using an electrowinning anode having an amorphous ruthenium oxide-containing catalytic layer formed on a conductive substrate in the chloride-based electrolyte, chlorine evolution on the anode is promoted as described earlier, thereby inhibiting cobalt oxyhydroxide deposition. Furthermore, when cobalt electrowinning is performed using an electrowinning anode having an amorphous iridium oxide-containing catalytic layer formed on a conductive substrate in the sulfuric acid- or chloride-based electrolyte, oxygen evolution on the anode is significantly promoted, thereby almost completely restraining cobalt oxyhydroxide deposition. The present invention further provides a cobalt electrowinning method in which an electrowinning anode having a catalytic layer, which contains amorphous iridium oxide and amorphous tantalum oxide, formed on a conductive substrate is used in a sulfuric acid-based electrolyte, which produces an extremely remarkable effect of restraining cobalt oxyhydroxide deposition and renders the electrowinning anode highly durable, making it possible to achieve long-term stable electrowinning.

While the present invention has been described with respect to the electrowinning anodes for use in cobalt electrowinning and the cobalt electrowinning processes using electrolytes containing divalent cobalt ions extracted from a cobalt ore, the invention is obviously useful in a recycle or recovery process in which high-purity cobalt is produced through any of the above processes and used for various purposes in various applications, and the used cobalt is recovered to extract divalent cobalt ions again and produce high-purity cobalt through electrolysis.

EFFECT OF THE INVENTION

The present invention achieves effects as follows.

1) In zinc electrowinning, an oxygen evolution potential is low and a potential increase due to a manganese compound is inhibited, so that an electrolysis voltage can be significantly reduced, making it possible to achieve the effect of significantly reducing electric energy consumption required for producing an equivalent amount of zinc metal on the cathode.

2) Also, since electric energy consumption can be reduced, it is possible to achieve the effect of significantly reducing electrolysis cost and zinc production cost.

3) Also, since manganese compound deposition on the anode can be inhibited, it is possible to achieve the effect of inhibiting occurrence of such deposition from resulting in an effective surface area on the anode being limited by a manganese compound or an electrolyzable area on the anode becoming non-uniform, so that zinc is non-uniformly deposited on a cathode and becomes difficult to recover or zinc with poor smoothness is deposited, resulting in reduced quality of zinc metal to be produced.

4) Also, it is possible to achieve the effect of preventing zinc non-uniformly grown on the cathode for the above reason from reaching the anode, thereby causing short-circuit so that electrowinning cannot be performed.

5) Also, since zinc can be inhibited from growing non-uniformly and dendritically due to the manganese compound as described above, it is possible to achieve the effect of shortening the distance between the anode and the cathode, thereby inhibiting the electrolysis voltage from increasing due to ohmic loss in the electrolyte.

6) Also, since manganese compound deposition on the anode can be inhibited, the deposit-removing routine maintenance can be reduced and the need to suspend the electrolysis for manganese compound removal is lessened, making it possible to achieve the effect of allowing stable electrowinning to be performed successively.

7) Also, since deterioration of the anode due to manganese compound deposition or removing maintenance-related deterioration of the anode, such as peeling of the catalytic layer of the anode which is caused when removing a tightly and coherently attached manganese compound, is inhibited, it is possible to achieve the effect of lengthening the life of the anode.

8) Also, since few divalent manganese ions in a solution used for electrowinning are consumed on the anode during electrolysis, divalent manganese ion becomes concentrated after the electrolysis, making it possible to achieve the effect of obtaining a solution available for manganese extraction/recovery.

9) Also, since various problems due to manganese compound deposition on the anode can be solved as described above, it is possible to achieve the effect of allowing stable electrowinning to be performed successively, so that maintenance and management tasks for electrowinning can be reduced and product management of obtained zinc metal can be facilitated.

Furthermore, the present invention can also achieve effects as follows.

1) In cobalt electrowinning, an oxygen or chlorine evolution potential is low and a potential increase due to cobalt oxyhydroxide is inhibited, so that an electrolysis voltage can be significantly reduced, making it possible to achieve the effect of significantly reducing electric energy required for producing an equivalent amount of cobalt metal.

2) Also, since electric energy consumption can be reduced, it is possible to achieve the effect of significantly reducing electrolysis cost and cobalt production cost.

3) Also, since cobalt oxyhydroxide deposition on the anode can be inhibited, it is possible to achieve the effect of inhibiting occurrence of such deposition from resulting in an effective surface area on the anode being limited by cobalt oxyhydroxide or an electrolyzable area on the anode becoming non-uniform, so that cobalt is non-uniformly deposited on a cathode and becomes difficult to recover or cobalt with poor smoothness is deposited, resulting in reduced quality of cobalt metal to be produced.

4) Also, it is possible to achieve the effect of preventing cobalt non-uniformly grown on the cathode for the above reason from reaching the anode, thereby causing short-circuit so that electrowinning cannot be performed.

5) Also, since cobalt can be inhibited from growing non-uniformly and dendritically due to cobalt oxyhydroxide as described above, it is possible to achieve the effect of shortening the distance between the anode and the cathode, thereby inhibiting the electrolysis voltage from increasing due to ohmic loss in the electrolyte.

6) Also, since cobalt oxyhydroxide deposition on the anode can be inhibited, the deposit-removing routine maintenance can be reduced and the need to suspend the electrolysis for cobalt oxyhydroxide removal is lessened, making it possible to achieve the effect of allowing stable electrowinning to be performed successively.

7) Also, since deterioration of the anode due to cobalt oxyhydroxide deposition or removing maintenance-related deterioration of the anode, such as peeling of the catalytic layer of the anode which is caused when removing tightly and coherently attached cobalt oxyhydroxide, is inhibited, it is possible to achieve the effect of lengthening the life of the anode.

8) Also, since few divalent positive cobalt ions in an electrolyte used for electrowinning are consumed on the anode during electrolysis, it is possible to achieve the effect of inhibiting divalent cobalt ions from being unnecessarily consumed in the electrolyte.

9) Also, since various problems due to cobalt oxyhydroxide deposition on the anode can be solved as described above, it is possible to achieve the effect of allowing stable electrowinning to be performed successively, so that maintenance and management tasks for cobalt electrowinning can be reduced and product management of obtained cobalt metal can be facilitated.

BEST MODE FOR CARRYING OUT THE INVENTION

Figure 1:
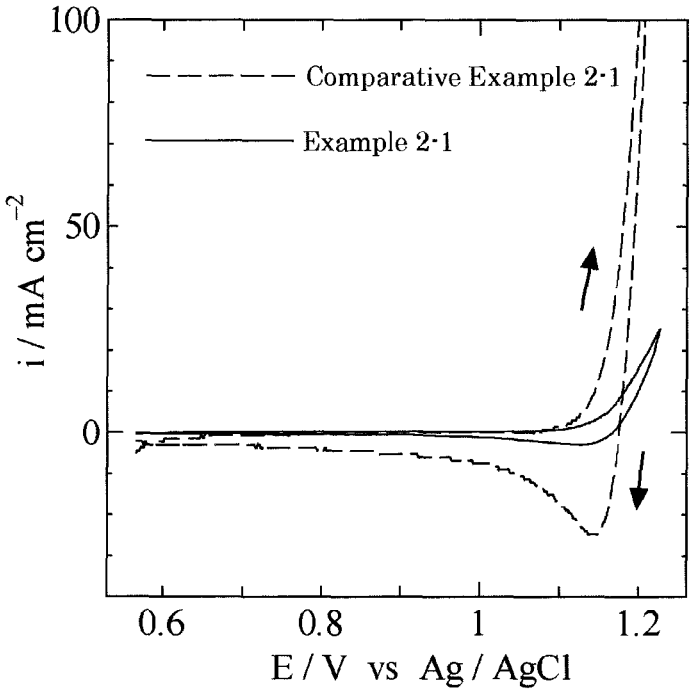
FIG. 1 provides cyclic voltammograms obtained in Example 2-1 and Comparative Example 2-1.

While the present invention will be described in more detail below by way of Examples and Comparative Examples, the present invention is not limited to the following examples.

EXAMPLES AND COMPARATIVE EXAMPLES RELATED TO ZINC ELECTROWINNING

Example 1-1

A commercially available titanium plate (5 cm long, 1 cm wide, 1 mm thick) was dipped and etched in a 10% oxalic acid solution at 90° C. for 60 minutes, and then washed with water and dried. An application liquid was prepared such that the mole ratio of hydrogen hexachloroiridate hexahydrate ($H_2IrCl_6.6H_2O$) to tantalum chloride ($TaCl_5$) in a butanol ($n\text{-}C_4H_9OH$) solution containing 6 vol. % concentrated hydrochloric acid was 80:20 and a total amount of iridium and tantalum was 70 mg/mL in terms of metal. The application liquid was applied to the titanium plate and then dried at 120° C. for 10 minutes before thermal decomposition for 20 minutes in an electric furnace maintained at 360° C. The application, drying and calcination was repeated five times, thereby producing an electrode having a catalytic layer formed on the titanium plate. The electrode was structurally analyzed by X-ray diffractometry, resulting in an X-ray diffraction image with no diffraction peak profile corresponding to either $IrO_2$ or $Ta_2O_5$, and therefore the catalytic layer of the electrode was confirmed to be formed of amorphous iridium oxide and amorphous tantalum oxide. Next, the catalytic layer of the electrode, which was coated with polytetrafluoroethylene tape and had a regulated area of 1 $cm^2$, and a platinum plate were used as an anode and a cathode, respectively, to perform constant-current electrolysis in a manganese sulfate solution obtained by dissolving 0.1 mol/L manganese sulfate in a 2 mol/L sulfuric acid aqueous solution, with current density 10 $mA/cm^2$, temperature 40° C., electrolysis time 20 minutes. While the state of the anode surface did not change significantly before and after the electrolysis, weight change measurements of the anode before and after the electrolysis demonstrated that a manganese compound of 0.9 $mg/cm^2$ was deposited by the electrolysis. Note that assuming that a manganese compound was deposited by the electrolysis with 100% current efficiency, a calculated weight increase value was 11 $mg/cm^2$, that is, the amount of deposition was equivalent to 8% of the calculated value.

Example 1-2

An electrode was produced in the same manner as the electrode production method of Example 1-1, except that the thermal decomposition temperature was changed from 360° C. to 380° C. The obtained electrode was structurally analyzed by X-ray diffractometry, the result being that a diffraction line corresponding to $IrO_2$ had a broadened pattern with overlapping small peaks and no diffraction peak profile corresponding to $Ta_2O_5$ was recognized, so that the catalytic layer was confirmed to be formed of amorphous iridium oxide, crystalline iridium oxide, and amorphous tantalum oxide. Next, constant-current electrolysis was performed with the method and conditions shown in Example 1-1. A change in weight of the anode before and after the electrolysis revealed that a manganese compound of 2.3 mg/cm$^2$ was deposited by the electrolysis.

Comparative Example 1-1

An electrode was produced in the same manner as the electrode production method of Example 1-1, except that the thermal decomposition temperature was changed from 360° C. to 470° C. The obtained electrode was structurally analyzed by X-ray diffractometry, the result being that a sharp diffraction peak profile corresponding to $IrO_2$ was recognized but any diffraction peak profile corresponding to $Ta_2O_5$ was not recognized, so that the catalytic layer was confirmed to be formed of crystalline iridium oxide and amorphous tantalum oxide. Next, constant-current electrolysis was performed with the method and conditions shown in Example 1-1. After the electrolysis, a deposit was clearly observed on the catalytic layer of the anode, and a change in weight of the anode before and after the electrolysis was examined, revealing that a manganese compound of 5 mg/cm$^2$ was deposited by the electrolysis.

As described above, it was revealed that in Example 1-1 where iridium oxide in the catalytic layer is amorphous, the amount of deposited manganese compound can be as much as 82% less than in Comparative Example 1-1 where amorphous iridium oxide is not contained in the catalytic layer. It was also revealed that the amount of deposited manganese compound in Example 1-2 can be as much as 54% less than in Comparative Example 1-1. On the other hand, electric double layer capacitance measurements in the sulfuric acid solution revealed that the electrodes in Examples 1-1 and 1-2 have increased effective surface areas compared to the electrode in Comparative Example 1-1, and particularly in Example 1-1, the electrode had an effective surface area six or more times larger than that in Comparative Example 1-1 so that oxygen evolution was significantly promoted. Furthermore, oxygen evolution potentials in the sulfuric acid solution were compared, and the result showed that the oxygen evolution potential at 50 mA/cm$^2$ was 0.2V lower in Example 1-1 than in Comparative Example 1-1, revealing that the oxygen evolution potential can be reduced drastically.

EXAMPLES AND COMPARATIVE EXAMPLES RELATED TO COBALT ELECTROWINNING

Example 2-1

A commercially available titanium plate (5 cm long, 1 cm wide, 1 mm thick) was dipped and etched in a 10% oxalic acid solution at 90° C. for 60 minutes, and then washed with water and dried. An application liquid was prepared such that the mole ratio of hydrogen hexachloroiridate hexahydrate ($H_2IrCl_6.6H_2O$) to tantalum pentachloride ($TaCl_5$) in a butanol (n-$C_4H_9OH$) solution containing 6 vol. % concentrated hydrochloric acid was 80:20 and a total amount of iridium and tantalum was 70 mg/mL in terms of metal. The application liquid was applied to the titanium plate and then dried at 120° C. for 10 minutes before thermal decomposition for 20 minutes in an electric furnace maintained at 360° C. The application, drying and calcination was repeated five times, thereby producing an electrode having a catalytic layer formed on the titanium plate. The electrode was structurally analyzed by X-ray diffractometry, resulting in an X-ray diffraction image with no diffraction peak profile corresponding to either $IrO_2$ or $Ta_2O_5$, and therefore the catalytic layer of the electrode was confirmed to be formed of amorphous iridium oxide and amorphous tantalum oxide. Next, the catalytic layer of the electrode, which was coated with polytetrafluoroethylene tape and had a regulated area of 1 cm$^2$, and a platinum plate were used as a working electrode and a counter electrode, respectively, and a cyclic voltammogram was measured under the following conditions: liquid temperature 60° C., scan rate 5 mV/s, using a chloride-based electrolyte with pH of 2.4 obtained by dissolving 0.3 mol/L $CoCl_2$ in distilled water with addition of hydrochloric acid. At this time, an Ag/AgCl electrode dipped in a KCl-saturated solution was used as a reference electrode.

Comparative Example 2-1

An electrode was produced in the same manner as the electrode production method of Example 2-1, except that the thermal decomposition temperature was changed from 360° C. to 470° C. The obtained electrode was structurally analyzed by X-ray diffractometry, the result being that a diffraction peak profile corresponding to $IrO_2$ was recognized but any diffraction peak profile corresponding to $Ta_2O_5$ was not recognized, so that the catalytic layer was confirmed to be formed of crystalline iridium oxide and amorphous tantalum oxide. Next, a cyclic voltammogram was measured with the method and conditions shown in Example 2-1.

The cyclic voltammograms obtained in Example 2-1 and Comparative Example 2-1 are shown in FIG. 1. As shown in FIG. 1, large oxidation current and large reduction current with a peak profile were observed for Comparative Example 2-1, while as for Example 2-1, oxidation current was considerably smaller than that in Comparative Example 2-1, and no reduction current was observed. The oxidation current observed for Comparative Example 2-1 corresponds to cobalt oxyhydroxide deposition, and the large reduction current with a peak profile corresponds to reduction of cobalt oxyhydroxide attached to the electrode. On the other hand, as for Example 2-1, since oxidation current was observed but no reduction current was observed, the oxidation reaction corresponds to evolution of oxygen and chlorine, rather than to cobalt oxyhydroxide evolution. That is, in Example 2-1, cobalt oxyhydroxide evolution was remarkably inhibited compared to Comparative Example 2-1.

Example 2-2

A commercially available titanium plate (5 cm long, 1 cm wide, 1 mm thick) was dipped and etched in a 10% oxalic acid solution at 90° C. for 60 minutes, and then washed with water and dried. Next, an application liquid was prepared such that the mole ratio of ruthenium trichloride trihydrate ($RuCl_3.3H_2O$) to titanium-n-butoxide (Ti $(C_4H_9O)_4$) in butanol (n-$C_4H_9OH$) was 30:70 and a total amount of ruthenium and titanium was 70 mg/mL in terms of metal. The application liquid was applied to the titanium plate and then dried at 120° C. for 10 minutes before thermal decomposition for 20 minutes in an electric furnace maintained at 360° C. The application, drying and calcination was repeated five times, thereby producing an electrode having a catalytic layer formed on the titanium plate. The electrode was structurally analyzed by X-ray diffractometry, but no peak profile was recognized in an X-ray diffraction image at a diffraction angle corresponding to $RuO_2$ but a weak diffraction line in a broadened pattern corresponding to a $RuO_2$—$TiO_2$ solid solution was recognized, and therefore the catalytic layer of the electrode was confirmed to contain amorphous ruthenium oxide.

Next, the catalytic layer of the electrode, which was coated with polytetrafluoroethylene tape and had a regulated area of 1 $cm^2$, and a platinum plate were used as a working electrode and a counter electrode, respectively, and a cyclic voltammogram was measured under the following conditions: liquid temperature 60° C., scan rate 25 mV/s, using a chloride-based electrolyte with pH of 1.6 obtained by dissolving 0.9 mol/L $CoCl_2$ in distilled water with addition of hydrochloric acid. At this time, an Ag/AgCl electrode dipped in a KCl-saturated solution was used as a reference electrode.

Comparative Example 2-2

An electrode was produced in the same manner as the electrode production method of Example 2-2, except that the thermal decomposition temperature was changed from 360° C. to 500° C. The obtained electrode was structurally analyzed by X-ray diffractometry, the result being that distinct diffraction peak profiles corresponding to $RuO_2$ and a $RuO_2$—$TiO_2$ solid solution were recognized, so that the catalytic layer was confirmed to contain crystalline ruthenium oxide but no amorphous ruthenium oxide. Next, a cyclic voltammogram was measured with the method and conditions shown in Example 2-2.

Figure 2:
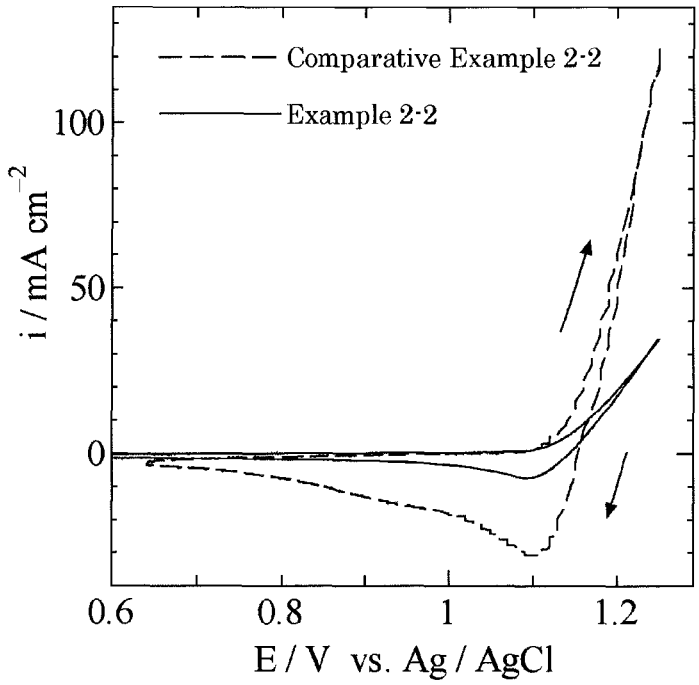
FIG. 2 provides cyclic voltammograms obtained in Example 2-2 and Comparative Example 2-2.

The cyclic voltammograms obtained in Example 2-2 and Comparative Example 2-2 are shown in FIG. 2. As shown in FIG. 2, large oxidation current and large reduction current with a peak profile were observed for Comparative Example 2-2, while as for Example 2-2, oxidation current was smaller than that in Comparative Example 2-2, and reduction current was considerably reduced. The oxidation current observed for Comparative Example 2-2 corresponds to cobalt oxyhydroxide deposition, and the large reduction current with a peak profile corresponds to reduction of cobalt oxyhydroxide attached to the electrode. On the other hand, as for Example 2-2, since both oxidation current and reduction current were lower than those in Comparative Example 2-2, cobalt oxyhydroxide deposition was remarkably inhibited in Example 2-2 compared to Comparative Example 2-2.

Example 2-3

An electrode was produced in the same manner as in Example 2-2. The catalytic layer of the electrode, which was coated with polytetrafluoroethylene tape and had a regulated area of 1 $cm^2$, and a platinum plate were used as an anode and a cathode, respectively, to perform constant-current electrolysis in a chloride-based electrolyte with pH of 1.6 obtained by dissolving 0.9 mol/L $CoCl_2$ in distilled water with addition of hydrochloric acid, with liquid temperature 60° C., current density 10 mA/$cm^2$, electrolysis time 40 minutes. Also, the mass of the anode was measured before and after the electrolysis.

Comparative Example 2-3

An electrode was produced in the same manner as in Comparative Example 2-2. Next, constant-current electrolysis was performed with the conditions and method shown in Example 2-3, and the mass of the anode was measured before and after the electrolysis.

In Example 2-3 and Comparative Example 2-3, a deposit was observed on the anode of Comparative Example 2-3 after the electrolysis, and from the change in mass before and after the electrolysis, cobalt oxyhydroxide of 6.9 mg/$cm^2$ was deposited. On the other hand, cobalt oxyhydroxide deposited on the anode of Example 2-3 was at 1.2 mg/$cm^2$, which is significantly low and equivalent to 17% of the amount of deposition in Comparative Example 2-3.

Example 2-4

Figure 3:
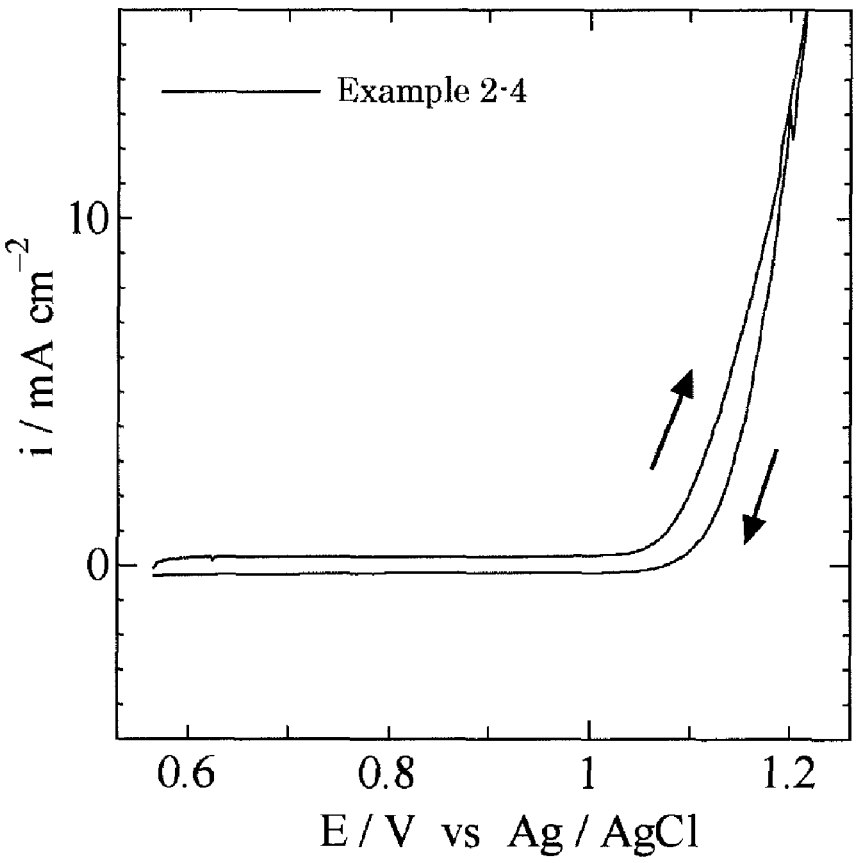
FIG. 3 provides a cyclic voltammogram obtained in Example 2-4.

An electrode was produced in the same manner as the electrode production method of Example 2-1, except that the thermal decomposition temperature was changed from 360° C. to 340° C. The electrode was structurally analyzed by X-ray diffractometry, resulting in an X-ray diffraction image with no diffraction peak profile corresponding to $IrO_2$ or $Ta_2O_5$, and therefore the catalytic layer of the electrode was confirmed to be formed of amorphous iridium oxide and amorphous tantalum oxide. Next, the catalytic layer of the electrode, which was coated with polytetrafluoroethylene tape and had a regulated area of 1 $cm^2$, and a platinum plate were used as a working electrode and a counter electrode, respectively, and a cyclic voltammogram was measured under the following conditions: liquid temperature 60° C., scan rate 5 mV/s, using a sulfuric acid-based electrolyte with pH of 2.4 obtained by dissolving 0.3 mol/L $CoSO_4.7H_2O$ in distilled water with addition of hydrochloric acid. At this time, an Ag/AgCl electrode dipped in a KCl-saturated solution was used as a reference electrode. A cyclic voltammogram shown in FIG. 3 demonstrates that oxidation current flowed through the electrode but no reduction current was observed. That is, cobalt oxyhydroxide evolution was completely inhibited.

Industrial Applicability

The present invention is applicable to zinc electrowinning for producing high-purity zinc through electrolysis using a solution of divalent zinc ions extracted from a zinc ore, and also applicable to zinc electrowinning intended to, for example, recover zinc metal from a zinc-containing substance recovered for recycling, through electrolysis using a solution having divalent zinc ions dissolved therein.

Furthermore, the present invention is applicable to cobalt electrowinning for producing high-purity cobalt through electrolysis using a solution of divalent cobalt ions extracted from a cobalt ore, and also applicable to cobalt electrowinning intended to, for example, recover cobalt metal from a cobalt-containing substance recovered for recycling, through electrolysis using a solution having divalent cobalt ions dissolved therein.

The invention claimed is:

1. A zinc electrowinning anode for use in zinc electrowinning, comprising a conductive substrate and a catalytic layer formed on the conductive substrate, wherein the catalytic layer contains amorphous iridium oxide.

2. The zinc electrowinning anode according to claim 1, wherein the catalytic layer contains amorphous iridium oxide and metal oxide selected from among titanium, tantalum, niobium, tungsten and zirconium.

3. The zinc electrowinning anode according to claim 1, wherein the catalytic layer contains amorphous iridium oxide and amorphous tantalum oxide.

4. The zinc electrowinning anode according to claim 1, wherein the catalytic layer contains amorphous iridium oxide, crystalline iridium oxide and amorphous tantalum oxide.

5. The zinc electrowinning anode according to claim 1, comprising an intermediate layer between the catalytic layer and the conductive substrate.

6. A zinc electrowinning method, wherein electrolysis is performed using an electrowinning anode according to claim 1.

7. A cobalt electrowinning anode for use in cobalt electrowinning, comprising a conductive substrate and a catalytic layer formed on the conductive substrate, wherein the catalytic layer contains amorphous iridium oxide or amorphous ruthenium oxide.

8. The cobalt electrowinning anode according to claim 7, wherein the catalytic layer contains amorphous iridium oxide and metal oxide selected from among titanium, tantalum, niobium, tungsten and zirconium.

9. The cobalt electrowinning anode according to claim 7, wherein the catalytic layer contains amorphous iridium oxide and amorphous tantalum oxide.

10. The cobalt electrowinning anode according to claim 7, wherein the catalytic layer contains amorphous ruthenium oxide and titanium oxide.

11. The cobalt electrowinning anode according to claim 7, comprising an intermediate layer between the catalytic layer and the conductive substrate.

12. A cobalt electrowinning method, wherein electrolysis is performed using an electrowinning anode according to claim 7.

13. The cobalt electrowinning method according to claim 12, wherein electrolysis is performed using a chloride-based electrolyte.

14. The cobalt electrowinning method according to claim 12, wherein electrolysis is performed using a sulfuric acid-based electrolyte.

* * * * *